US009878358B2

(12) United States Patent
Chen et al.

(10) Patent No.: US 9,878,358 B2
(45) Date of Patent: Jan. 30, 2018

(54) COOLING SECTION HAVING LOWER SPRAY BAR

(71) Applicant: PRIMETALS TECHNOLOGIES AUSTRIA GMBH, Linz (AT)

(72) Inventors: Jian Chen, St. Marien (AT); Sieglinde Ehgartner, Linz (AT); Reinhard Karl, Klosterneuburg (AT); Erich Opitz, Moenchhof (AT); Florian Poeschl, Linz (AT); Alois Seilinger, Linz (AT); Thomas Trickl, Koppl (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 186 days.

(21) Appl. No.: 14/779,575

(22) PCT Filed: Feb. 19, 2014

(86) PCT No.: PCT/EP2014/053186
§ 371 (c)(1),
(2) Date: Sep. 24, 2015

(87) PCT Pub. No.: WO2014/154399
PCT Pub. Date: Oct. 2, 2014

(65) Prior Publication Data

US 2016/0052034 A1 Feb. 25, 2016

(30) Foreign Application Priority Data

Mar. 25, 2013 (EP) ..... 13160792

(51) Int. Cl.
*B21B 39/12* (2006.01)
*B21B 45/02* (2006.01)

(52) U.S. Cl.
CPC ..... *B21B 45/0218* (2013.01); *B21B 45/0233* (2013.01); *B21B 39/12* (2013.01)

(58) Field of Classification Search
CPC . B21B 43/00; B21B 45/0203; B21B 45/0215; B21B 45/0218; B21B 45/0233; B21B 39/12
See application file for complete search history.

(56) References Cited

U.S. PATENT DOCUMENTS 4,497,180 A * 2/1985 Graham ..... B21B 45/0233 134/122 R
4,723,562 A * 2/1988 Wilmotte ..... B21B 45/0218 134/122 R (Continued)

FOREIGN PATENT DOCUMENTS

CN 101253010 A 8/2008
CN 201200991 Y 3/2009

(Continued)

OTHER PUBLICATIONS

Notice of Reasons for Rejection dated Oct. 31, 2016 in corresponding Japanese Patent Application No. 2016-504523 (with English language translation)(total 7 pages).

(Continued)

*Primary Examiner* — Edward Tolan
(74) *Attorney, Agent, or Firm* — Ostrolenk Faber LLP

(57) ABSTRACT

A cooling section for a flat rolled material (1) has a frame structure (2), in which a plurality of transport rollers (3) for the flat rolled material (1) are arranged one after another transversely to a transport direction (x) and spaced apart (a). Each transport roller (3) mounted in the frame structure (2) rotates about a respective roller axis (4). The roller axes (4) run orthogonally to the transport direction (x) and horizontally, so that the transport rollers (4) form a pass line (5) for the flat rolled material (1). At least one lower spray bar (6) arranged beneath the pass line (5) has a base block (7) beneath the transport rollers (3) for a liquid coolant (8). Guide sections (9) project upwards from the base block (7)

(Continued)

into spaces between the transport rollers (3). Each guide section (9) has an upper terminating element (10) on which spray nozzles (11) are arranged, which feed the coolant (8), which had been fed into the base block (7), to be sprayed onto the flat rolled material (1) from below. The guide sections (9) have a respective length (1) in the transport direction (x) of the flat rolled material (1). That length (1) decreases at least in the vicinity of the respective upper terminating elements (10), in the direction of the respective upper terminating element (10).

13 Claims, 3 Drawing Sheets

(56) References Cited

U.S. PATENT DOCUMENTS

| | | | | |
|---|---|---|---|---|
| 5,186,018 | A | 2/1993 | van Ditzhuijzen et al. | |
| 5,327,763 | A * | 7/1994 | Kramer | C21D 1/667 72/201 |
| 7,328,598 | B2 * | 2/2008 | Cramer | B21B 45/0233 266/46 |
| 2001/0027672 | A1 * | 10/2001 | Barten | B21B 37/32 72/201 |
| 2005/0167897 | A1 | 8/2005 | Cramer et al. | |
| 2006/0060271 | A1 | 3/2006 | Fujibayashi et al. | |
| 2009/0211670 | A1 | 8/2009 | Fujibayashi et al. | |

FOREIGN PATENT DOCUMENTS

| | | | |
|---|---|---|---|
| CN | 101767113 | A | 7/2010 |
| DE | 102 15 229 | A1 | 10/2003 |
| EP | 1 527 829 | A1 | 5/2005 |
| JP | S54-152113 | U1 | 10/1979 |
| JP | S57-156830 | A | 9/1982 |
| JP | S57-052104 | Y | 11/1982 |
| JP | S58-163519 | A | 9/1983 |
| JP | H 04-59115 | | 2/1992 |
| JP | H07-214136 | A | 8/1995 |
| JP | H09-85326 | A | 3/1997 |
| JP | 2005-528218 | A | 9/2005 |
| JP | 2007-530290 | A | 11/2007 |
| JP | 4436142 | B2 | 3/2010 |
| WO | WO 99/30849 | A1 | 6/1999 |

OTHER PUBLICATIONS

First Office Action dated May 16, 2016 in corresponding Chinese Patent Application No. 201480018354.7 with Search Report (English language translation)(16 total pages).

International Search Report dated Apr. 3, 2014 issued in corresponding International patent application No. PCT/EP2014/053186.

International Preliminary Report on Patentability dated Mar. 18, 2015 issued in corresponding International patent application No. PCT/EP2014/053186.

Written Opinion dated Apr. 3, 2014 issued in corresponding International patent application No. PCT/EP2014/053186.

European Search Report dated Aug. 6, 2013 issued in corresponding European patent application No. 13 16 0792.

* cited by examiner

COOLING SECTION HAVING LOWER SPRAY BAR

CROSS-REFERENCE TO RELATED APPLICATIONS

The present application is a 35 U.S.C. §§371 national phase conversion of PCT/EP2014/053186, filed Feb. 19, 2014, which claims priority of European Patent Application No. 13160792.1, filed Mar. 25, 2013, the contents of which are incorporated by reference herein. The PCT International Application was published in the German language.

BACKGROUND OF THE INVENTION

The present invention relates to a cooling section for a flat rolled material,

- where the cooling section has a structural frame in which a plurality of transport rollers is arranged, one behind another in a direction of transport for the flat rolled material,
- where transport rollers which are immediate neighbors when looking in the direction of transport have in each case a gap between them,
- where the transport rollers are each mounted in the structural frame so that each roller can rotate about a roller axis,
- where the roller axes are aligned orthogonally to the direction of transport and extend horizontally, so that the transport rollers form a pass-line for the flat rolled material,
- where at least one lower spray bar is arranged beneath the pass-line.

A cooling line of this type is generally known.

In the prior art, so-called laminar cooling is often effected. In laminar cooling, the cooling section has at least one spray bar, which is arranged beneath the transport rollers. Welded into the spray bar and running parallel to the roller axes there is usually a row of small tubes, which project upwards in the direction of the rolled material. These small tubes are spaced apart, on the one hand looking in the direction of transport, from the transport rollers and also, on the other hand looking in the direction of the roller axes, from each other. The coolant which is applied from beneath onto the rolled material can therefore be drained away without problem.

Recently, so-called intensive cooling has become known. Intensive cooling is a new type of cooling method for cooling a rolled material during hot rolling, or immediately thereafter. It is used in order to adjust selectively the microstructure, and with it the mechanical properties, of the end product. In particular, so-called AHSS (=advanced high strength steels) call for ever more intensity of cooling and flexibility of cooling. These requirements are met by intensive cooling. For intensive cooling, the lower spray bars must be constructed differently than for laminar cooling. In particular, the lower spray bars must have larger dimensions. Furthermore, the lower spray bars must withstand the higher pressures which arise with intensive cooling.

In the prior art, a lower spray bar for intensive cooling is known. The known spray bar fills the entire space between directly neighboring transport rollers. This hinders the drainage of the coolant sprayed from below onto the flat rolled material. Consequently, a substantial excess quantity of coolant is required in order to achieve any particular cooling effect.

From DE 102 15 229 A1 a cooling section is known, for a flat rolled material, in which the cooling section has a structural frame in which a plurality of transport rollers is arranged one behind another in the direction of transport of the flat rolled material. In each case, transport rollers which are immediate neighbors looking in the direction of transport have a gap between them. Each of the transport rollers is mounted in the structural frame so that each roller can rotate about a roller axis, whereby the roller axes are oriented orthogonally to the direction of transport and horizontally, so that the transport rollers form a pass-line for the flat rolled material. Arranged underneath the pass-line is at least one lower spray bar which has a base block, arranged beneath the transport rollers, into which is fed a liquid coolant. The lower spray bar has a base body which tapers towards its upper side. On its upper side, the base body has bores, into which are set spray tubules, which are closed off in the upward direction by a nozzle. The spray tubules have a cross section which is as such constant.

SUMMARY OF THE INVENTION

The objective of the present invention is to structure a cooling section, of the type mentioned in the introduction, such that it is possible in a simple way to drain off the coolant which is sprayed from below onto the flat rolled material.

This objective is achieved by a cooling section disclosed herein.

In accordance with the invention, a cooling section of the type mentioned in the introduction is thereby further constructed so that;

- the at least one lower spray bar has a base block arranged beneath the transport rollers;
- a liquid coolant is fed into the base block;
- a number of feeder sections project upwards from the base block into gaps between the transport rollers;
- the feeder sections have an upper closing element, on which are arranged spray nozzles which feed the coolant into the base block, and the coolant is sprayed from underneath onto the flat rolled material;
- each of the feeder sections has a width, in the direction of transport of the flat rolled material; and
- at least in the neighborhood of the upper closing element concerned these widths reduce in the direction towards the upper closing element.

The inventive tapering of the first external dimensions achieves the effect that the widths of the feeder sections in the regions of the transport rollers are significantly smaller that the gap between immediately neighboring transport rollers.

It is possible that the feeder sections taper down over their entire vertical extent. Alternatively, it is possible that the widths of the feeder sections in the neighborhood of the base block are constant.

In one preferred embodiment of the inventive cooling section, provision is made that each of the feeder sections has a lower part which abuts the base block and an upper part which contains the upper closing element concerned. In the region of each lower part, the widths of the feeder sections are constant, in the region of each upper part the widths of the feeder sections reduce towards the upper closing element, and the lower part concerned and the upper part concerned are bolted together. By this construction it is possible, in particular, to increase the ease of assembly and maintenance.

In one particularly preferred embodiment of the inventive cooling section, in addition to a tapering of the widths, provision is made that each of the feeder sections has a breadth, looking in the direction of the roller axes, that these breadths are constant in the region of the underpart concerned and that in the region of the upper part the breadths reduce in the direction towards the upper closing element concerned.

The approach of this embodiment—namely the reduction in the breadths—can also be realized if the feeder sections are not split into lower parts and upper parts. In this case, at least in the neighborhood of the upper closing element concerned, the breadths reduce in the direction towards the relevant upper closing element.

Preferably, the spray nozzles will be screwed into the relevant upper closing element.

The spray nozzles which are arranged on the upper closing elements generally incorporate several rows of spray nozzles, in particular at least two outer rows of spray nozzles, which are arranged one behind another in the direction of transport of the flat rolled material. Each of the spray nozzles in the outer rows has a principal spray direction, with a vertical component directed upwards from below. In one preferred embodiment of the present invention, each of the principal spray directions has in addition a horizontal component. The horizontal components of the principal spray directions of the outer rows of spray nozzles are in this case directed away from each other.

In an embodiment, the spray nozzles arranged on the upper closing elements include in addition, at least one central row of spray nozzles, which is arranged between the outer rows of spray nozzles in the direction of transport of the flat rolled material. In this case, the spray nozzles of the central row will preferably have a principal spray direction which is oriented purely vertically, upwards from below.

In an embodiment, the widths reduce in steps in the direction towards the upper closing element. Preferably, however, the widths reduce steplessly.

Preferably there are strengthening ribs arranged at least in the base block. These enable the base block to better withstand pressure loadings—including changing pressure loadings due to the lower spray bar being switched on and off. If necessary, strengthening ribs can also be arranged in or on the feeder sections.

Provision is preferably be made to feed the liquid coolant into the base block parallel to the direction of the roller axes.

This simplifies the constructional layout of the lower spray bar.

In general, in addition to the lower spray bar, there is at least one upper spray bar arranged above the pass-line, into which is also fed a liquid coolant. On the underside of the upper bar there are further spray nozzles which feed the coolant into the upper spray bar to be sprayed from above onto the surface of the flat rolled material.

The characteristics, features and advantages described above for this invention, together with the way in which these are achieved, will be more clearly and sharply comprehensible in conjunction with the following description of the exemplary embodiments, which will be explained in more detail in conjunction with the drawings. These show schematic diagrams.

DESCRIPTION OF EMBODIMENTS

Figure 1:
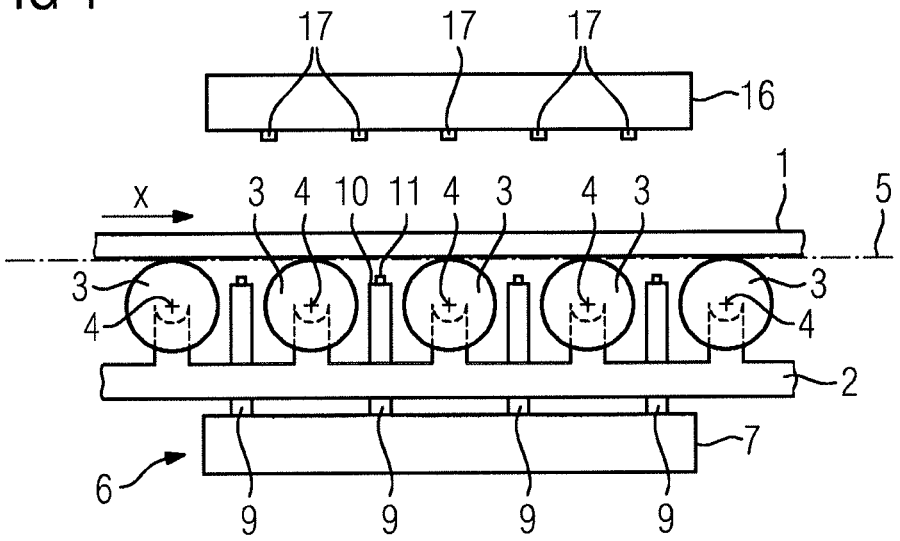
FIG. 1 shows a cooling section, from the side.
Figure 2:
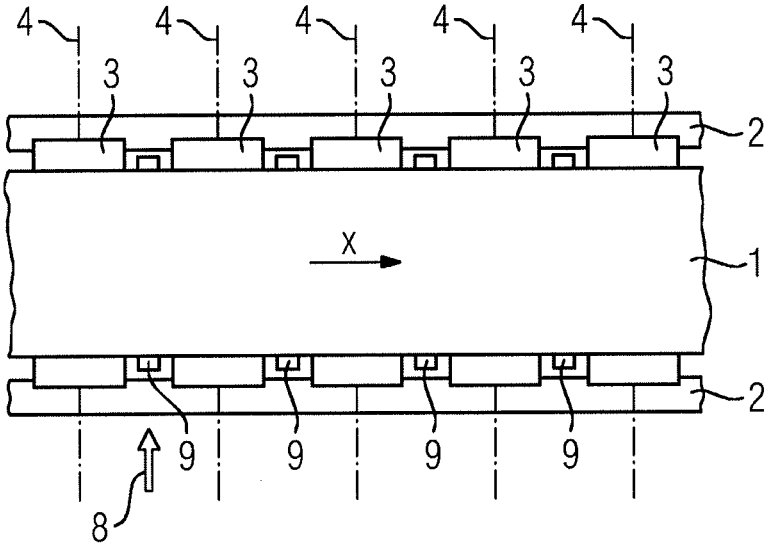
FIG. 2 shows the cooling section in FIG. 1, from above.
Figure 3:
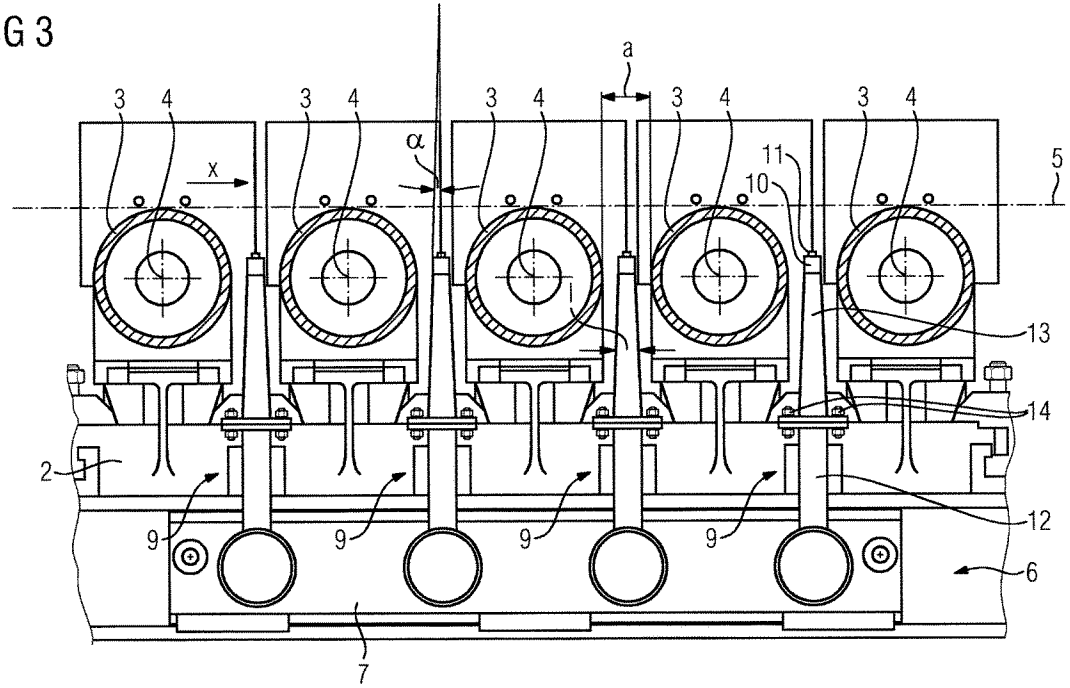
FIG. 3 shows a partial view of the cooling section in FIG. 1, from the side.

As shown in FIGS. 1 to 3, a cooling section for a flat rolled material 1 has a structural frame 2. Arranged in the structural frame 2 are a plurality of transport rollers 3. The transport rollers 3 are arranged one behind another in a direction of transport x for the flat rolled material 1. Transport rollers 3 which are immediate neighbors, in the transport direction x, have in each case a gap 'a' from each other. Each of the transport rollers 3 is mounted in the structural frame 2 so that it can rotate about an associated roller axis 4. The roller axes 4 are aligned orthogonally to the direction of transport x. In addition they are horizontally oriented. In this way, the transport rollers 3 form a (horizontal) pass-line 5 for the flat rolled material 1.

Arranged beneath the pass-line 5 is a lower spray bar 6. In general, there are several lower spray bars 6. The explanations which follow, in which reference is made to the lower spray bar 6 and its components, are thus to be regarded as exemplary.

The lower spray bar 6 has a base block 7. This base block 7 is arranged beneath the transport rollers 3. Into the base block 7 is fed a liquid coolant 8. In principle, the liquid coolant 8 can be fed into the base block 7 from any arbitrary direction. Preferably, the liquid coolant 8 will, as indicated in FIG. 2 by an appropriately labeled arrow, be fed into the base block 7 parallel to the direction of the roller axes 4. Arranged at least in the base block 7 there are preferably strengthening ribs (not shown in the FIG). Insofar as is necessary, strengthening ribs can also be arranged in or on the feeder sections 9. These strengthening ribs are also not shown in the FIG.

A number of feeder sections 9 project upwards from the base block 7 into gaps between the transport rollers 3. Generally, several feeder sections 9 are present. In what follows, reference will only be made to one of the feeder sections 9 and its components—as a representative of all the feeder sections 9. However, the corresponding embodiments are applicable to all the feeder sections 9.

As shown in FIG. 3, the feeder section 9 has an upper closing element 10. Arranged on the closing element 10 are spray nozzles 11. By means of the spray nozzles 11, the liquid coolant 8, which had previously been fed into the base block 7, is sprayed onto the flat rolled material 1 from beneath. The spray nozzles 11 can, in particular, be screwed into the upper closing element 10.

Looking in the direction of transport x of the flat rolled material 1, the feeder section 9 has a width 1. This width 1 varies when looking in a vertical direction. In particular, at least in the neighborhood of the upper closing element 10, the width 1 reduces in the direction towards the upper closing element 10. Preferably, there will be a stepless reduction in the width 1. A first angle of inclination $\alpha$, formed between the boundary of the width 1 and the vertical direction, generally lies between 3° and 10°, for example 4° to 7°. Due to the reduction in the width 1, it is possible in particular to achieve the effect that the width 1 of the feeder section 9 is significantly less than the size of the gap a between the two immediately neighboring transport rollers 3. In particular, the width 1 in this region is preferably at most 80% of the gap a. It can also be even smaller, for example up to at most 50% of the gap a.

It is possible that the width 1 reduces over the entire height of the feeder section 9. Preferably, however, the width 1 is constant in the neighborhood of the base block 7. Even there, it can already be less than the size of the gap a between the two immediately neighboring transport rollers 3, as shown in FIG. 3. However, this is not absolutely essential.

As shown in FIG. 3, the feeder section 9 has a lower part 12 which abuts onto the base block 7. The feeder section 9 has in addition an upper part 13. This upper part 13 contains the upper closing element 10. The lower part 12 and the upper part 13 are bolted to each other by threaded connectors. In the region of the lower part 12, the width 1 is preferably constant. In the region of the upper part 13 on the other hand the width 1 reduces towards the upper closing element 10.

Figure 4:
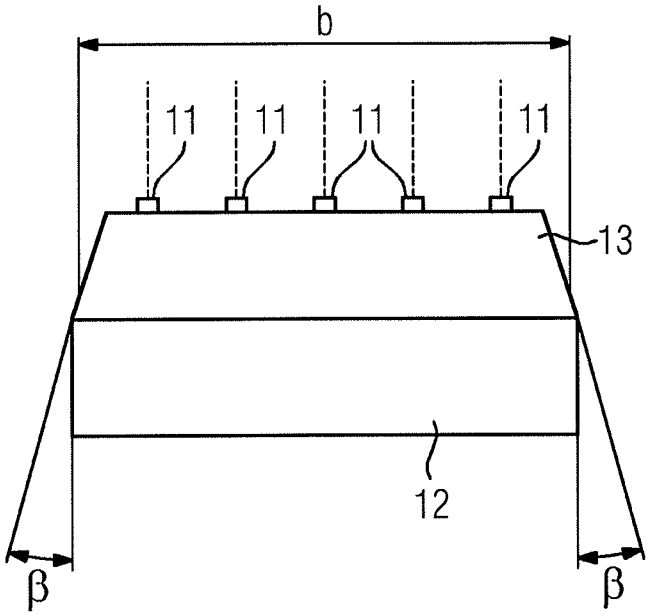
FIG. 4 shows a feeder section, seen looking in the direction of transport of a rolled material.

As shown in FIG. 4, the feeder section 9 has a breadth b looking in the direction of the roller axes 4. In the neighborhood of the upper closing element 10, the breadth b preferably also reduces, analogously to the width 1, in the direction towards the upper closing element 10. In the case that the feeder section 9 is split into a lower part 12 and an upper part 13, the width 1 will preferably be constant in the region of the lower part 12. In the region of the upper part 13 on the other hand, the breadth b reduces in the direction towards the upper closing element 10.

In a way analogous to the width 1, the narrowing of the breadth b will preferably be stepless. A second angle of inclination β, formed between the boundary of the breadth b and the vertical direction, generally lies between 5° and 15°, for example 7° to 12°.

Figure 5:
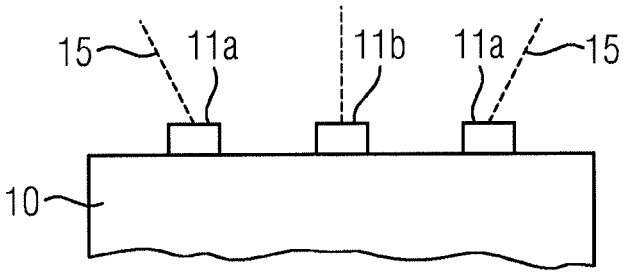
FIG. 5 shows enlarged, the upper part of a feeder section, seen from the side.

As shown in FIG. 5, the spray nozzles 11 arranged on the upper closing element 10 include in each case at least two outer rows 11*a* of spray nozzles 11. The outer rows 11*a* are arranged one behind another looking in the direction of transport x. In addition, there can be at least one central row 11*b* of spray nozzles 11. If the central row 11*b* of spray nozzles 11 is present it is arranged, looking in the direction of transport x, between the outer spray nozzles 11*a*.

As shown in FIG. 5, the spray nozzles 11 of each of the outer rows 11*a* have a principal spray direction 15. The principle spray directions 15 have a (common) vertical component which is—naturally—oriented upwards from below. As shown in FIG. 5, the principal spray directions 15 of each of the outer rows 11*a* of spray nozzles 11 have in addition a horizontal component. It can be seen that the horizontal components of the principal spray directions 15 of the outer rows 11*a* of spray nozzles 11 are directed away from each other.

The spray nozzles 11 of the central row 11*b* also have their own principal spray direction. The principal spray direction of the spray nozzles 11 of the central row 11*b* does not have a reference mark in FIG. 5. The principal spray direction of the central row 11*b* of spray nozzles 11 is generally purely vertical, upwards from below.

The more detailed explanation above was exclusively about the lower spray bar 6 and its construction. In general there is, as shown in the diagram in FIG. 1, in addition to the lower spray bar 6 (at least) one upper spray bar 16 arranged above the pass-line 5. A liquid coolant 8 is also fed into the upper spray bar 16. On its underside, the upper spray bar 16 has further spray nozzles—these have the reference mark 17 to distinguish them from the spray nozzles 11 on the lower spray bar 6. By means of the spray nozzles 17 of the upper spray bar 16, the coolant 8 which has been fed into the upper spray bar 16 is sprayed from above onto the flat rolled material 1.

The present invention has many advantages. In particular, the coolant usage for the lower spray bar 6 can be significantly reduced. Savings on coolant 8 of about 40% to about 50% are possible.

Although the invention has been illustrated and described in more detail by the preferred exemplary embodiment, the invention is not restricted by the examples disclosed, and a specialist can derive other variations therefrom without going outside the scope of protection for the invention.

LIST OF REFERENCE MARKS

1 Flat rolled material
2 Structural frame
3 Transport rollers
4 Roller axes
5 Pass-line
6 Lower spray bar
7 Base block
8 Liquid coolant
9 Feeder sections
10 Upper closing element
11, 17 Spray nozzles
11*a*, 11*b* Rows of spray nozzles
12 Lower part
13 Upper part
14 Threaded connectors
15 Principal spray directions
16 Upper spray bar
a Gap sizes
b Breadth
l Width
x Transport direction
α First angle of inclination
β Second angle of inclination

The invention claimed is:

1. A cooling section for a flat rolled material, the cooling section comprising:

a structural frame and a plurality of transport rollers arranged in the frame, one transport roller being behind another in a first direction of transport of the flat rolled material; in the first direction, immediately neighboring ones of the transport rollers being separated by a gap; each of the transport rollers being mounted in the structural frame to rotate about a respective roller axis for the roller, and the roller axes being aligned orthogonally to the first direction and being aligned horizontally, so that the transport rollers form a pass-line for the flat rolled material to pass over the rollers;

at least one lower spray bar arranged underneath the pass-line, the at least one spray bar having a base block arranged underneath the transport rollers, and the base block being configured to be fed a liquid coolant; and a plurality of feeder sections projecting upwards from the base block and into spaces between the immediately neighboring ones of the transport rollers; each feeder section having an upper closing element and spray nozzles arranged on the respective upper closing elements for spraying liquid that was fed into the base block onto the flat rolled material from below; each of the feeder sections having a first dimension in the first direction, and, at least near each of the upper closing elements, the first dimension and a second dimension of the feeder section decrease in a second direction towards the upper closing element, the first dimension being measured in a first plane, the second dimension being measured in a second plane and in a third direction of the roller axes, the second plane being perpendicular to the first plane.

2. The cooling section as claimed in claim 1, wherein the first dimension is a width of the feeder section, and, in the region of the transport rollers, the widths of the feeder sections are at most 80% of a gap (a) between each two immediately neighboring ones of the transport rollers.

3. The cooling section as claimed in claim 1, wherein the first dimension is a width of the feeder section and each of the feeder sections has a lower part which abuts the base block and has an upper part which contains the respective closing element, and in the region of the respective lower part the width of each feeder section is constant, while in the region of the respective upper part, the width of each feeder section decreases in the second direction, while the respective lower part and the respective upper part are fastened together.

4. The cooling section as claimed in claim 3, wherein the second dimension of the feeder section is a breadth and, in the third direction, the breadth of each feeder section is constant, in the region of the respective lower part and in the region of the respective upper part, the breadth decreases in the second direction.

5. The cooling section as claimed in claim 1, wherein the second dimension of the feeder section is a breadth, and in the third direction, the breadth of each of the feeder sections, at least near the upper closing element of the feeder section, decreases in the second direction.

6. The cooling section as claimed in claim 1, wherein the spray nozzles are screwed into the respective upper closing element.

7. The cooling section as claimed in claim 1, wherein:

the spray nozzles are arranged on the upper closing element, the spray nozzles on each closing element including at least two outer rows of spray nozzles, the outer rows of spray nozzles of the upper closing elements being arranged one behind another in the first; each spray nozzle in each outer row having a principal spray direction, wherein the principal spray direction has a vertical component oriented upward from below and a horizontal component, and the horizontal components of the principal spray directions of the outer rows of the spray nozzles are oriented away from each other.

8. The cooling section as claimed in claim 7, wherein:

the spray nozzles on each upper closing element include at least one central row of the spray nozzles and in the first direction, the central row of spray nozzles is arranged between the outer rows of spray nozzles, and the spray nozzles of the central row have a principal spray direction which is oriented vertically upwards from below.

9. The cooling section as claimed in claim 1, wherein the first dimension is a width of the feeder section and the width of each feeding section decreases steplessly in the second direction.

10. The cooling section as claimed in claim 1, further comprising strengthening ribs arranged at least in the base block.

11. The cooling section as claimed in claim 10, further comprising strengthening ribs arranged in or on the feeder sections.

12. The cooling section as claimed in claim 1, further comprising means for feeding the liquid coolant into the base block in a direction parallel to the third direction.

13. The cooling section as claimed in claim 1, further comprising at least one upper spray bar, configured to have a liquid coolant fed therein, the spray bar having an underside on which further spray nozzles are arranged, the further spray nozzles being configured to spray coolant, that was fed into the upper spray bar, from above onto the flat rolled material.

* * * * *